United States Patent [19]

Hogan

[11] 4,051,621

[45] * Oct. 4, 1977

[54] HOMOHEDRAL MODULE GENUS EXTENDER

[76] Inventor: John Paul Hogan, 600 Elm St., Williamsburg, Iowa 52361

[ * ] Notice: The portion of the term of this patent subsequent to Apr. 20, 1993, has been disclaimed.

[21] Appl. No.: 674,935

[22] Filed: Apr. 8, 1976

[51] Int. Cl.[2] ..... A63H 33/10

[52] U.S. Cl. ..... 46/26; 52/608; 52/DIG. 10; 35/72

[58] Field of Search ..... 46/24, 25, 26; 35/34, 35/72; 52/81, DIG. 10, 608; 206/436

[56] References Cited

U.S. PATENT DOCUMENTS

| | | | |
|---|---|---|---|
| 3,502,091 | 3/1970 | Corbin | 52/DIG. 10 |
| 3,604,130 | 9/1971 | Forrstrum | 35/34 |
| 3,660,952 | 5/1972 | Wilson | 52/81 |

FOREIGN PATENT DOCUMENTS

| | | | |
|---|---|---|---|
| 1,331,238 | 5/1963 | France | 52/81 |

OTHER PUBLICATIONS

Cundy & Rollet, Mathematical Models, 2nd ed., copyright 1961, pub. by Oxford Univ. Press, London, pp. 98–99.

*Primary Examiner*—F. Barry Shay

[57] ABSTRACT

The genus extender is a toy block designed to be used with a plurality of homohedral modules, either by itself or with other genus extenders, in constructing geometric models with a topological genus of two or more.

18 Claims, 15 Drawing Figures

HOMOHEDRAL MODULE GENUS EXTENDER

In my recent application, entitled Homohedral Module (Ser. No. 518,529, filed Oct. 29, 1974; now U.S. Pat. No. 3,950,888), I described a toy block that imitates the icosahedron's unique ability at three dimensional intersection wth other icosahedra along established pentangular line segments that form the bases of either tangent or opposite pentangular pyramids on the surface of the icosahedra. I further described this block as being convex-concave in design. It is concave where a pentangular pyramid has been removed from an icosahedron and replaced with a surface of such a degree of concavity that a pentangular pyramid, as exists on another icosahedron or homohedral module block, will fit comfortably within it so that its pentangular base edges are made tangent with the pentangular base edges of the concave surface.

I further stated that in some configurations a plurality of these blocks will turn in upon themselves and form circles with a topological genus of one. Upon further investigation I have discovered that configurations of two or more interconnected circles and of circles divided into two or more sections could be constructed, but that to achieve such a topological genus of two or more, a new toy block had to be used along with a plurality of homohedral modules.

This new toy block could be described simply as the product of fusing two homohedral modules so that a pentangular base of a pyramid on one module is made tangent with the pentangular base of a pyramid on the other module.

The primary object of this present invention is to enlarge upon the geometric patterns and forms of fused icosahedra available for children and curious adults to play with and study—patterns and forms with topological genera of two or more.

Additional objects and advantages will become apparent in the following description of specific embodiments of this invention made in conjunction with the accompanying drawings in which.

When two icosahedra have each been truncated about two non-adjacent vertices by the removal of two pentangular pyramids (see FIG. 6, FIG. 7 or FIGS. 6 and 7), and when these two truncated icosahedra have been joined, truncated pentangular face to truncated pentangular face, the basic convex structure of the genus extender can be said to exist. When the remaining truncated pentangular faces are replaced with surfaces of such a degree of concavity that a pentangular pyramid as exists on another genus extender, icosahedron or homohedral module block will fit comfortably within each of them, so that its pentangular base edges are made tangent with the pentangular base edges of each of the concave surfaces, the basic convex-concave structure of the genus extender can be said to exist.

Figure 10:
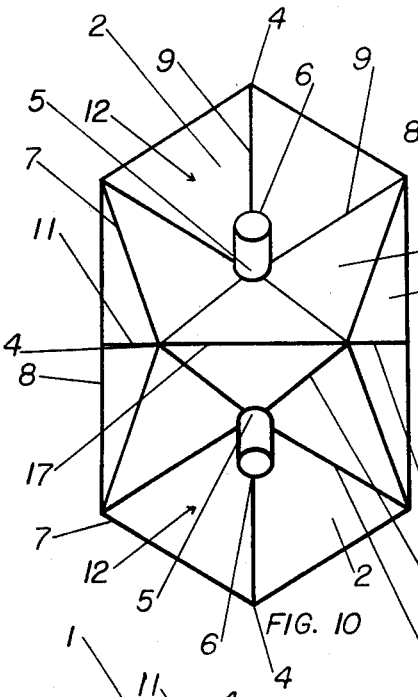
FIG. 10 is a front view of a type A1 genus extender.
Figure 12:
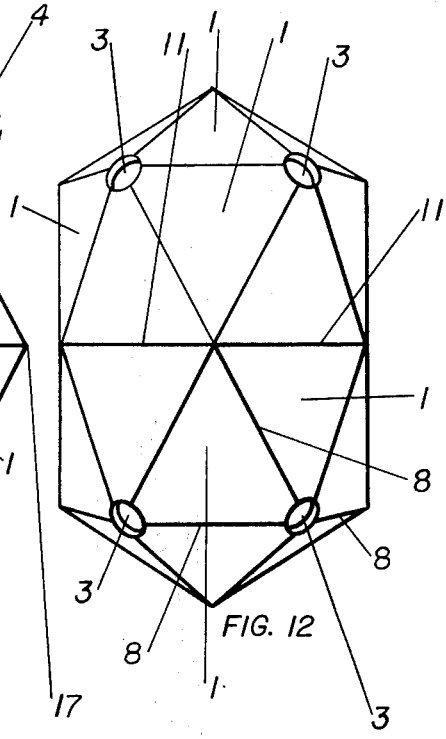
FIG. 12 is a back view of a type A1 genus extender.

Looking at FIGS. 10 and 12, it can be seen that the typical genus extender is composed of a total of 30 planar triangular faces 1 and 2, seventeen vertex points 3, 4 and 5 and 45 edges. In its preferred embodiment, 20 of the block's faces are identical equilateral triangular 1 in shape and define the convex surface of the block. The remaining 10 faces 2 are isosceles triangular in shape, with bases 7 identical in length to the sides of the equilateral faces—they define the two concave clusters 12 of five triangles on the block's surface. Fifteen of the block's vertices are either wholly convex 3 or a combination convex-concave 4; the remaining two vertices are wholly concave 5 and occur at the centers of the concave clusters.

The edges are divided into two main groups: the 35 that define the equilateral triangular faces and are identical in length when compared to one another 7, 8 and 11; the ten edges 9 that radiate from the two concave vertices are also identical in length when compared to one another, but when compared to the other 35 edges, they are found to be slightly longer. In the first group, up to 18 of the edges 8 radiate from the wholly convex vertices 3 and have dihedral angles identical to those on the surface of a regular icosahedron FIG. 5 where or when all vertex and edge angles are measured internally, up to five of the edges 11 have dihedral angles that are slightly concave and form the border between the two joined truncated icosahedra, and up to ten of the edges 7 form the bases of the isosceles triangular faces 2 and have dihedral angles that are acutely convex—more so than any of the other edges. The ten edges 9 that radiate from the two concave vertices have dihedral angles which, when measured externally, are found to be slightly less in dihedral angle than those present along the edges 8 radiating from the wholly convex vertices.

In my preferred embodiment, connecting apertures are present at each of the wholly convex vertices 3. Up to four may be present on any one block. Both concave vertices 5, on any one block, possess a male connecting device 6 at their center of such a length and diameter that they fit into any aperture occurring at a convex vertex 3 on the surface of another genus extender, homohedral module or icosahedron block, and hold the two blocks together snugly when the five edges 7 that are the bases of the isosceles faces of the one block are tangent with any five pentangular co-planar line segments formed by the edges 7, 8 or 11 that define the equilateral pentangular base of a pyramid on the other block.

There are five configurations the genus extender can assume, these being based on how the two icosahedra it is composed of are truncated and how they are positioned in their joined state. An icosahedron FIG. 5 can be truncated about two non-adjacent vertices in two different ways. A type A truncation FIG. 6 occurs when the two planes of truncation 10 are not parallel, but do share a common edge 13. A type B truncation FIG. 7 occurs when the two planes of truncation 10 are not tangent, but possibly parallel, if they occur on a regular icosahedron.

Figure 3:
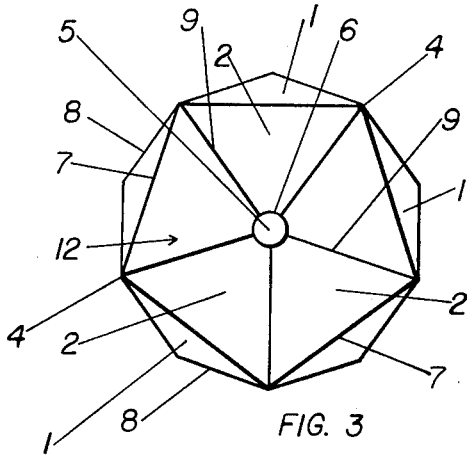
FIG. 3 is a top view of a type B genus extender.
Figure 4:
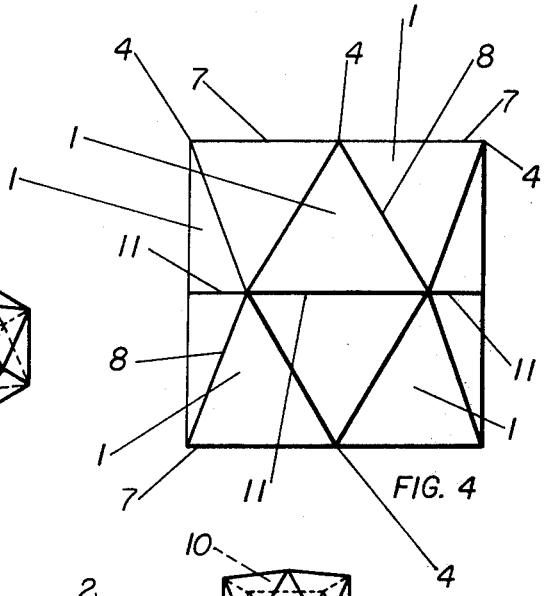
FIG. 4 is a front view of a type B genus extender.

FIGS. 3 and 4 show two views of the preferred embodiment of a type B genus extender. This block is derived from two joined type B FIG. 7 truncated icosahedra. Its two concave surface clusters have base edges 7 that are parallel but not tangent to each other. This block is unique in that it has no wholly convex vertices. This means that there are no apertures on its surface to engage a male connecting device from another genus extender or homohedral module block. It does have a complete set of five slightly concave edges 11 occurring where the two truncated icosahedra are joined.

Figure 1:
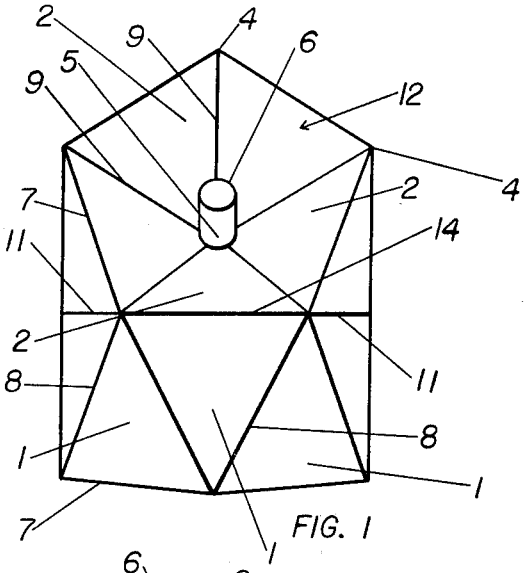
FIG. 1 is a perspective view of a type AB genus extender.
Figure 2:
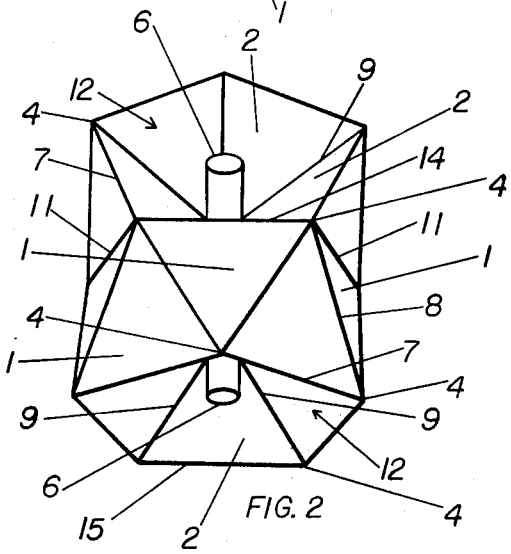
FIG. 2 is a lower perspective view of a type AB genus extender.

FIGS. 1 and 2 show views of a type AB genus extender. This block is derived from the joining of a type B truncated icosahedron FIG. 7 to a type A truncated icosahedron FIG. 6. Its two concave surface clusters 12 have base edge 7 planes that are neither parallel nor tangent, though one base edge 14 from one cluster is parallel to the most distant base edge 15 of the other concave surface cluster, when the block is based on truncated regular icosahedra. This block also has two wholly convex vertices, with nine convex surface edges 8 radiating from them, which means that there are two apertures on its surface able to engage a male connecting device from another genus extender or homohedral module block; but it has only four slightly concave edges 11 occurring where the two truncated icosahedra are joined.

Figure 6:
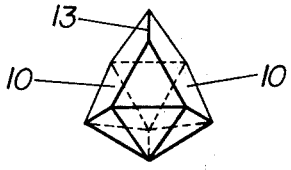
FIG. 6 is a front view of an A type truncated icosahedron.
Figure 7:
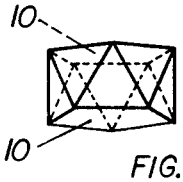
FIG. 7 is a front view of a B type truncated icosahedron.
Figure 13:
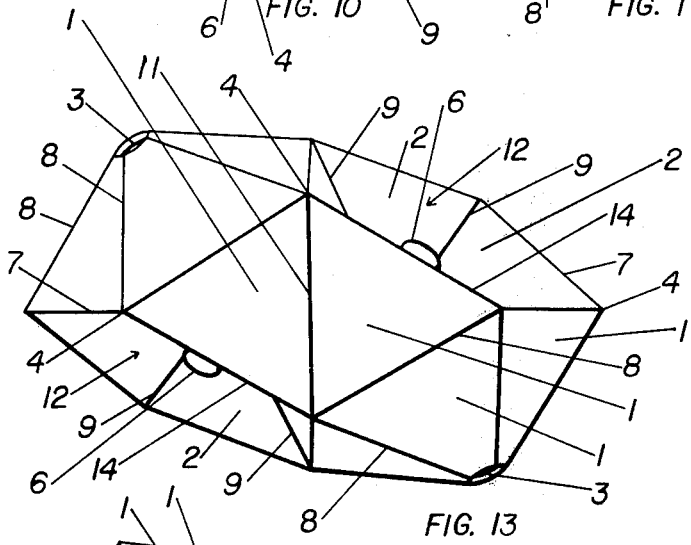
FIG. 13 is a front view of a type A genus extender.
Figure 14:
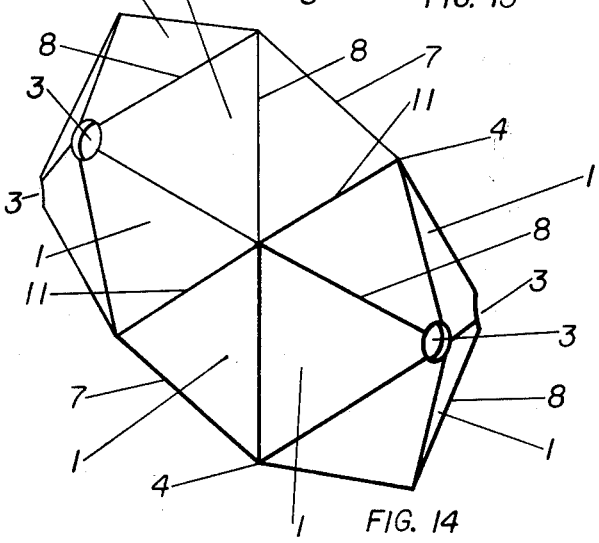
FIG. 14 is a back view of a type A genus extender.

FIGS. 13 and 14 show views of the preferred embodiment of a type A genus extender, which is the product of the union of two type A FIG. 6 truncated icosahedra. Neither concave surface cluster 12 has base edge 7 planes that are parallel or tangent, though the proximate edges 14, one from each cluster, are parallel in the sense that when extended they are not tangent in Euclidian space. This block has four engaging apertures centered at its four wholly convex vertices 3. It also has a full 18 edges 8 that are identical in dihedral angle to convex edges on an icosahedron; but it only has three edges 11 with the slightly concave dihedral angles that form part of the border between the two joined icosahedra.

Figure 8:
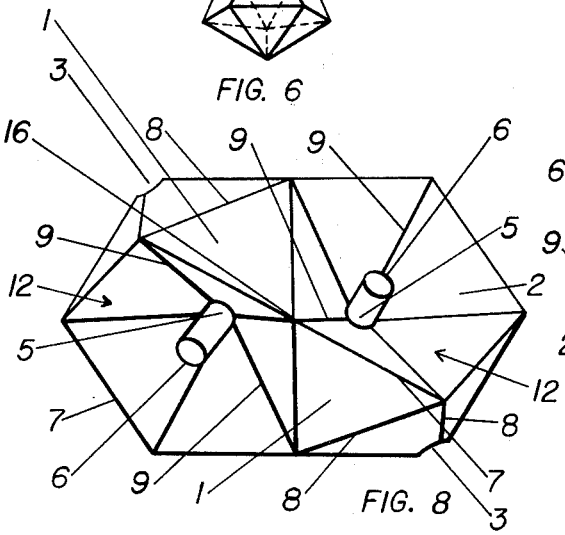
FIG. 8 is a front perspective view of a type A0 genus extender.
Figure 9:
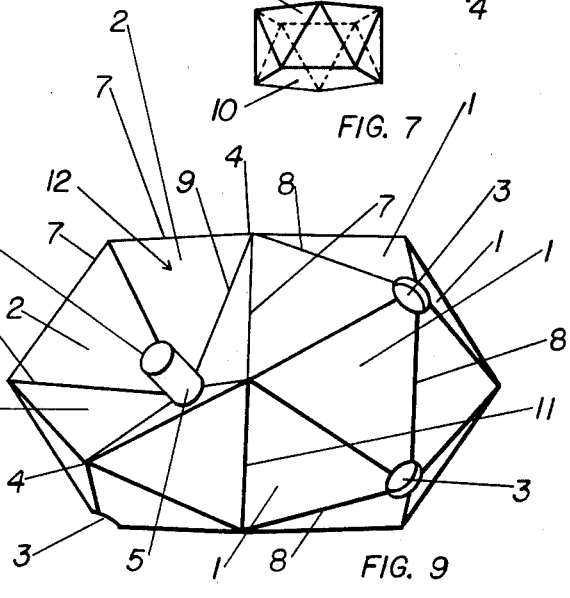
FIG. 9 is a side perspective view of a type A0 genus extender.

FIGS. 8 and 9 show views of a type A0 genus extender. This block is also composed of two joined type A truncated icosahedra and both its concave surface clusters 12 have base edge 7 planes that are not parallel. It differs from the type A genus extender in that the base 7 edges of its two concave surface clusters 12 are tangent at one point 16. This block, like all other A type blocks, has four apertures on its surface, centered on the four wholly convex vertices 3. It also has a full 18 edges 8 radiating from the wholly vertices that have dihedral angles identical to the angles generated on the convex edges of an icosahedron. And it too has just three edges 11 with the slightly concave dihedral angles that form part of the border between the two joined truncated icosahedra.

Figure 11:
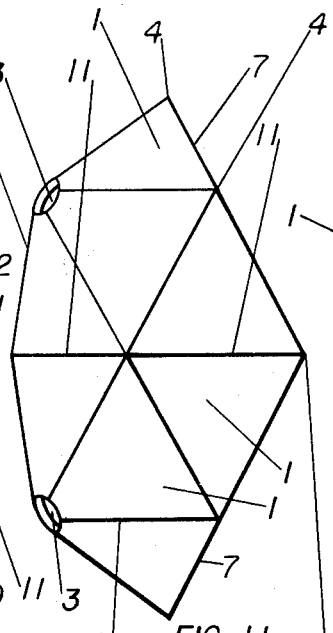
FIG. 11 is a side view of a type A1 genus extender.

Finally, FIGS. 10–12 show various views of a type A1 genus extender. This block is also composed of two joined type A, see FIG. 6, truncated icosahedra, with both its concave surface clusters 12 having base edge 7 planes that are not parallel. It differs from both the type A and type A0 blocks in that its concave surface clusters share one edge 17, and therefore have linear tangency. Like the other two type A blocks, type A1 genus extender has four apertures centered on its four wholly convex vertices 3, and it too has eighteen edges 8 radiating from its convex vertices that are identical in dihedral angle to those generated along the convex edges on an icosahedron; its only other difference from the type A and type A0 blocks is that it has four slightly concave edges 11 running between its two joined members, where the other two types have only three such edges.

Deviations from the preferred embodiment by any of the five genus extender configurations are possible and perhaps probable depending upon the type of manufacturing process that is used to produce them. In my preferred embodiment I assume that the genus extender is made out of a plastic material that has been either blow or rotational molded. But injection molding could be used; subunits could be injection molded and then assembled to form a genus extender. Other means of fabrication, using component parts, could be employed, with the finished module composed of either plastic, wood, metal, cardboard or any of a multitude of diverse materials and combinations. A genus extender could also be made out of a solid material, like wood. The concave portion of such a block might take on a different shape, being more concave, and perhaps not even faceted, as it is in the preferred embodiment.

The means of connection between any two extenders, a genus extender and a homohedral module or a genus extender and an icosahedron block might be through the use of dowel pins which are independent of the blocks into whose convex and concave centered apertures they would be pressed. The connection means might be independent of the pin-aperture approach altogether and use an adhesive or other type of interconnection means.

It should also be noted that even when, in my preferred embodiment, two pentangular co-planar line segments of two individual blocks are tangent, their enclosed surfaces are only proximate and not actually tangent, there is no reason why these surfaces couldn't be tangent. It is quite conceivable that the concave surfaces 2 could be equilateral triangular in shape.

The most economical variation in forming a genus extender might be for the convex surfaces and the pentangular co-planar mating edges to retain their structural integrity, but for the concave surfaces, as previously described, to be non-existent and in their place simply a means of attachment, perhaps an aperture or preferably a male connecting device, centered exactly where a pin would occur at the convex vertex in the preferred embodiment. In effect such a block would simply be a shell, with some protuberances or apertures, depending upon the way it is looked at. Such a block just might be less expensive in terms of labor and materials than a genus extender which encloses space within its surfaces. Therefore it just might be the best suited for production.

Figure 5:
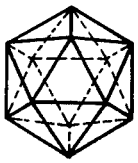
FIG. 5 is a front view of a regular icosahedron.
Figure 15:
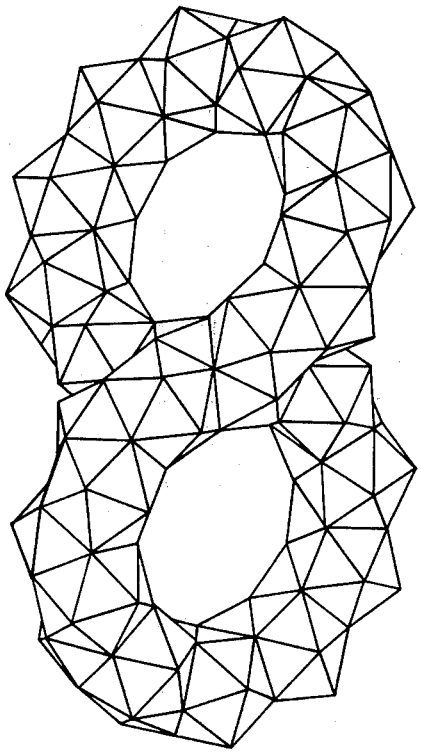
FIG. 15 is a perspective view of two joined homohedral rings.

In my preferred embodiment, the genus extender is based on the regular icosahedron FIG. 5, which is characterized by the identical equilateral triangular planes that make up its surface. It should be mentioned strongly and clearly that some embodiments of the genus extender FIGS. 13 or 14 might be based on a slightly irregular icosahedron to work properly—those embodiments that are used in the construction of two or more joined homohedral rings FIG. 15, for instance.

I have attempted to include as many variations of the invention as was proper in the specification. These variations are intended to be descriptive rather than merely limiting; especially in view of any further variation which the claims encompass, but is not mentioned in the specification for lack or space or obviousness.

I claim:

1. A toy block of convex-concave design in which the convex surface is identical to a surface on two joined, double truncated icosahedra, the truncations being formed by removal of a cluster of five icosahedral faces which form a pentangular pyramid about a vertex, said truncated icosahedra being joined along two truncation surfaces thus formed; and in which the concave surfaces are located at the remaining two truncation surfaces and are of such a degree of concavity that when a wholly convex surface surrounding a vertex on a similar block, an analogous icosahedron block or homohedral module, is fitted within it, a set of pentangular edges on each block are made tangent to one another.

2. A toy block as claimed in claim 1 having means of connection to similar blocks.

3. A toy block as claimed in claim 2 in which said means of connection occur at all wholly convex vertices and at the two wholly concave surfaces' centers, said means of connection being apertures into which pins may be inserted and secured and used to secure said similar blocks in a tangential manner.

4. A toy block as claimed in claim 2 in which said means of connection occur at all wholly convex vertices and at the two wholly concave surfaces' centers, said means of connection occurring at each of the wholly convex vertices being an aperture, and said means of connection occurring at the center of each of said wholly concave surface being a male connector, which may be inserted into any of said apertures on a said similar block, so as to secure the two of them in a tangential manner.

5. A toy block as claimed in claim 1 in which said convex surface is identical to a surface on two joined, double truncated regular icosahedra and in which said wholly concave surfaces are each in the form of a cluster of five equilateral triangular surfaces, whose combined apices form a wholly concave vertex.

6. A toy block as claimed in claim 5 having means of connection to other similar blocks.

7. A toy block as claimed in claim 6 in which said means of connection occur at all wholly convex vertices and at both of the wholly concave vertices, said means of connection being apertures into which pins may be inserted and secured and used to secure other said similar blocks, analogous icosahedron blocks or homohedral modules in tangential manner.

8. A toy block as claimed in claim 6 in which said means of connection occur at all wholly convex vertices and at both of the wholly concave vertices, said means of connection occurring at each of the wholly convex vertices being an aperture, and said means of connection occurring at each of the wholly concave vertices being a male connector which may be inserted into any of said apertures on a said similar block so as to secure the two of them in a tangential manner.

9. A toy block as claimed in claim 1 in which said convex surface is identical to a surface on two joined, double truncated regular icosahedra, and in which said wholly concave surfaces are each in the form of a cluster of five substantially identical isosceles triangular surfaces, the individual isosceles triangular surfaces having bases substantially identical in length to edges on said convex surface, and having sides slightly longer than the edges on said convex surface; whose combined apices form a wholly concave vertex.

10. A toy block as claimed in claim 9 having means of connection to other similar blocks.

11. A toy block as claimed in claim 10 in which said means of connection occur at all wholly convex vertices and at both of the wholly concave vertices, said means of connection are apertures into which pins may be inserted and secured and used to secure other said similar blocks, analogous icosahedron blocks or homohedral modules in a tangential manner.

12. A toy block as claimed in claim 10 in which said means of connection occur at all wholly convex vertices and at both of the wholly concave vertices, said means of connection occuring at each of the wholly convex vertices being an aperture, and said means of connection occurring at each of the wholly concave vertices being a male connector which may be inserted into any of said apertures on a said similar block, so as to secure the two of them in a tangential manner.

13. A toy block as claimed in claim 1 in which said convex surface is identical to a surface on two joined, double truncated icosahedra, the two truncations on each icosahedron being not tangent to one another.

14. A toy block as claimed in claim 1 in which said convex surface is identical to a surface on two joined, double truncated icosahedra, the truncations on one icosahedron being tangent to one another along a common edge, the truncations on the other icosahedron being not tangent to one another.

15. A toy block as claimed in claim 1 in which said convex surface is identical to a surface on two joined, double truncated icosahedra, the two truncations on each icosahedron being tangent to one another along a common edge.

16. A toy block as claimed in claim 15 in which said remaining two truncation surfaces are not tangent to one another.

17. A toy block as claimed in claim 15 in which said remaining two truncation surfaces are tangent to one another at one point.

18. A toy block as claimed in claim 15 in which said remaining two truncation surfaces are tangent to one another along a common edge.

* * * * *